US008847095B2

(12) United States Patent
Donzel et al.

(10) Patent No.: US 8,847,095 B2
(45) Date of Patent: Sep. 30, 2014

(54) HIGH-VOLTAGE SWITCHING DEVICE

(75) Inventors: Lise Donzel, Wettingen (CH); Judith Kessler, Oberrohrdorf (CH); Alexey Sokolov, Baden (CH); Markus Abplanalp, Baden-Dättwil (CH); Davide Riboni, Lodi (IT); Roberto Cameroni, Milan (IT)

(73) Assignee: ABB Research Ltd., Zurich (CH)

( * ) Notice: Subject to any disclaimer, the term of this patent is extended or adjusted under 35 U.S.C. 154(b) by 247 days.

(21) Appl. No.: 13/568,917

(22) Filed: Aug. 7, 2012

(65) Prior Publication Data

US 2013/0057083 A1 Mar. 7, 2013

(30) Foreign Application Priority Data

Sep. 6, 2011 (EP) ..... 11180139

(51) Int. Cl.

| | |
|---|---|
| ***H01H 9/40*** | (2006.01) |
| ***H01H 33/666*** | (2006.01) |
| ***H01H 33/14*** | (2006.01) |
| *H01H 33/664* | (2006.01) |

(52) U.S. Cl.

CPC ..... *H01H 33/14* (2013.01); *H01H 33/6647* (2013.01); *H01H 33/666* (2013.01)

USPC ..... 218/7

(58) Field of Classification Search

USPC ..... 218/1–7, 12, 84

See application file for complete search history.

(56) References Cited

U.S. PATENT DOCUMENTS

| | | | | |
|---|---|---|---|---|
| 3,405,245 | A | 10/1968 | Toshio et al. | |
| 3,697,712 | A * | 10/1972 | Chabala | 218/12 |
| 4,445,017 | A * | 4/1984 | Stewart et al. | 218/1 |
| 5,347,096 | A * | 9/1994 | Bolongeat-Mobleu et al. | 218/84 |
| 7,511,243 | B2 * | 3/2009 | Laskowski et al. | 218/7 |
| 7,550,691 | B2 | 6/2009 | Wristen et al. | |
| 2009/0084762 | A1 | 4/2009 | Wristen et al. | |

FOREIGN PATENT DOCUMENTS

WO WO 02/29839 A1 4/2002

OTHER PUBLICATIONS

Search Report issued on Jan. 26, 2012, by the European Patent Office for Application No. 11180139.5.

* cited by examiner

*Primary Examiner* — Truc Nguyen

(74) *Attorney, Agent, or Firm* — Buchanan Ingersoll & Rooney PC

(57) ABSTRACT

A high voltage switching device includes a current interruption assembly having at least one vacuum chamber, a fixed contact assembly having a first fixed contact and a second fixed contact positioned inside the vacuum chamber, and first and second movable-contact assemblies including a first movable contact and a second movable contact, respectively. A single mechanism actuates the first and second movable-contact assemblies between a first position and second position. In the first position, the first and second movable contacts are electrically coupled with the first and second fixed contacts, respectively. And in the second position, the first and second moveable contacts are electrically separated the same. The first movable contact and the second movable contact move, along a reference axis, one towards the other or away from the other based on the actuating mechanism.

19 Claims, 3 Drawing Sheets

HIGH-VOLTAGE SWITCHING DEVICE

RELATED APPLICATION

This application claims priority under 35 U.S.C. §119 to European Patent Application No. 11180139.5 filed in Europe on Sep. 6, 2011, the content of which is hereby incorporated by reference in its entirety.

FIELD

The present disclosure relates to a switching device, such as a high-voltage switching device for applications with rated voltage above 1 kV.

BACKGROUND INFORMATION

Known electric grids for transmitting and/or distributing power to various loads and users are equipped with various switching devices. These switching devices, such as current interrupters or circuit breakers, have the main task of properly protecting the grid in which they are used as well as various loads and equipment connected therewith from damages which may be caused for example by electrical faults, e.g. short circuits.

To this end, a circuit breaker can include an interruption chamber with current interruption mechanisms constituted by at least one fixed contact and a corresponding moving contact. When a fault occurs, the circuit breaker can be opened by suitable actuating mechanisms which cause the movable contact to electrically separate from the fixed contact, thus interrupting the flow of current.

During opening, the mutual separation of the contacts is accompanied by the generation of an electric arc between the two contacts which should be extinguished as quickly as possible.

To face this issue, different solutions have been implemented over the years. One of the most practiced solutions uses gaseous substances such as nitrogen, noble gases, compressed air, sulphur hexafluoride ($SF_6$) and mixtures thereof inside the interrupting chamber. But with these substances it is indispensable to use devices for monitoring the pressure of the gas used and for replenishing it in order to maintain the dielectric performance of the switching device. Further, safety systems can be adopted in order to avoid and/or indicate any loss outside the device. This arrangement affects the constructive complexity of the circuit breaker and its overall reliability.

In addition, such gases represent a major concern about environmental issues, with regard to SF6 and its negative impact on the greenhouse effect.

For such reasons, manufacturers have developed a different current interruption technology where the contacts are positioned and separate from each other inside a vacuum interruption chamber. In practice the vacuum interruption chamber surrounds a sealed space inside which a vacuum atmosphere is created and where the contacts separate.

Unfortunately, the dielectric rating of a single vacuum chamber is rather limited, e.g. up to some tens of kV, and in order to overcome such limit there have been proposed various solutions using two or more vacuum chambers or vacuum circuit breakers within the same switching device.

Clearly, such solutions using two or more vacuum chambers or circuit breakers from one side allow increasing the overall dielectric rating of the device but from the other side introduce other issues, such as complexity of the mechanisms used to actuate the various contacts, overall size of the device which may become rather voluminous and cumbersome, problems in balanced voltage sharing among the two or more vacuum chambers, or other related foreseeable and unforeseeable issues.

Examples of such known solutions are for example described in U.S. Pat. Nos. 5,347,096 and 7,550,691.

Although known solutions perform their functions in a rather satisfying way, there is still desire and room for further improvements.

SUMMARY

An exemplary high-voltage switching device is disclosed. The switching device comprising: an outer casing; a current interruption assembly including at least one vacuum chamber which is positioned inside said outer casing; a fixed contact assembly including a first fixed contact and a second fixed contact positioned inside said at least one vacuum chamber; a first movable-contact assembly and a second movable-contact assembly including a first movable contact and a second movable contact, respectively; a single mechanism for actuating both said first and second movable-contact assemblies between a first position in which said first movable contact and said second movable contact are electrically coupled inside said at least one vacuum chamber with said first fixed contact and said second fixed contact, respectively, and a second position in which said first movable contact and said second movable contact are electrically separated inside said at least one vacuum chamber from said first fixed contact and said second fixed contact, respectively, wherein said fixed contact assembly is interposed between said first and second movable contact assemblies, said first movable contact assembly, said second movable contact assembly, and said actuating mechanism is arranged so that said first movable contact and said second movable contact move, along a reference axis, one towards the other when switching from said second position to said first position and one away from the other when switching from said second position to said first position.

An exemplary high-voltage switching device is disclosed. The device comprising: a current interruption assembly including at least one vacuum chamber; a fixed contact assembly including a first fixed contact and a second fixed contact positioned inside said at least one vacuum chamber; a first movable-contact assembly having a first movable contact; a second movable-contact assembly having a second movable contact; a single mechanism for actuating said and second movable-contact assemblies between a first position and a second position, wherein in said first position said first movable contact is electrically coupled to said first fixed contact and said second movable contact is electrically coupled to said second fixed contact, wherein in said second position said first movable contact is electrically separated from said first fixed contact and said second movable contact is electrically separated from said second fixed contact, and wherein said fixed contact assembly is interposed between said first and second movable contact assemblies, and wherein said first movable contact and said second movable contact move towards and away from one another along a reference axis based on a respective starting position and actuation by the actuating mechanism.

BRIEF DESCRIPTION OF THE DRAWINGS

Further characteristics and advantages will become apparent from the description of some preferred but not exclusive exemplary embodiments of a high-voltage switching device according to the present disclosure, illustrated only by way of non-limitative examples with the accompanying drawings, wherein.

DETAILED DESCRIPTION

Figure 1:
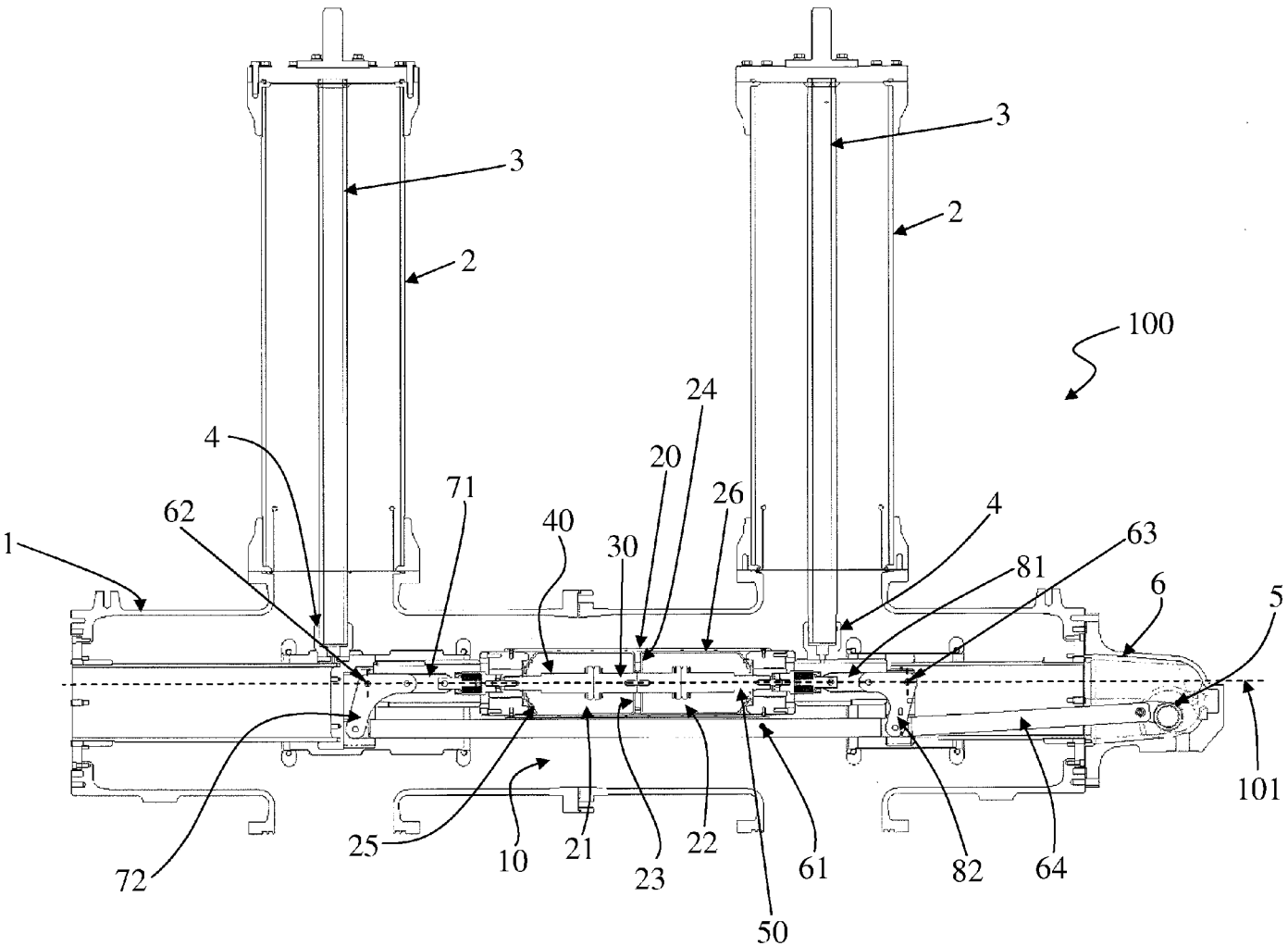
FIG. 1 is a side view showing the high-voltage switching device in a first closed position in accordance with an exemplary embodiment of the present disclosure.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

Exemplary embodiments of the present disclosure are directed to a high voltage switching device including an outer casing; a current interruption assembly comprising at least one vacuum chamber which is positioned inside said outer casing, a fixed contact assembly including a first fixed contact and a second fixed contact positioned inside said at least one vacuum chamber, a first movable-contact assembly and a second movable-contact assembly including a first movable contact and a second movable contact respectively; a single mechanism for actuating both said first and second movable-contact assemblies between a first position in which said first movable contact and said second movable contact are electrically coupled inside said at least one vacuum chamber with said first fixed contact and said second fixed contact, respectively, and a second position in which said first movable contact and said second movable contact are electrically separated inside said at least one vacuum chamber from said first fixed contact and said second fixed contact, respectively, in that said fixed contact assembly is interposed between said first and second movable contact assemblies, and wherein said first movable contact assembly, said second movable contact assembly and said actuating mechanism are arranged so as said first movable contact and said second movable contact move, along a reference axis, one towards the other when switching from said second position to said first position and one away from the other when switching from said second position to said first position.

Figure 2:
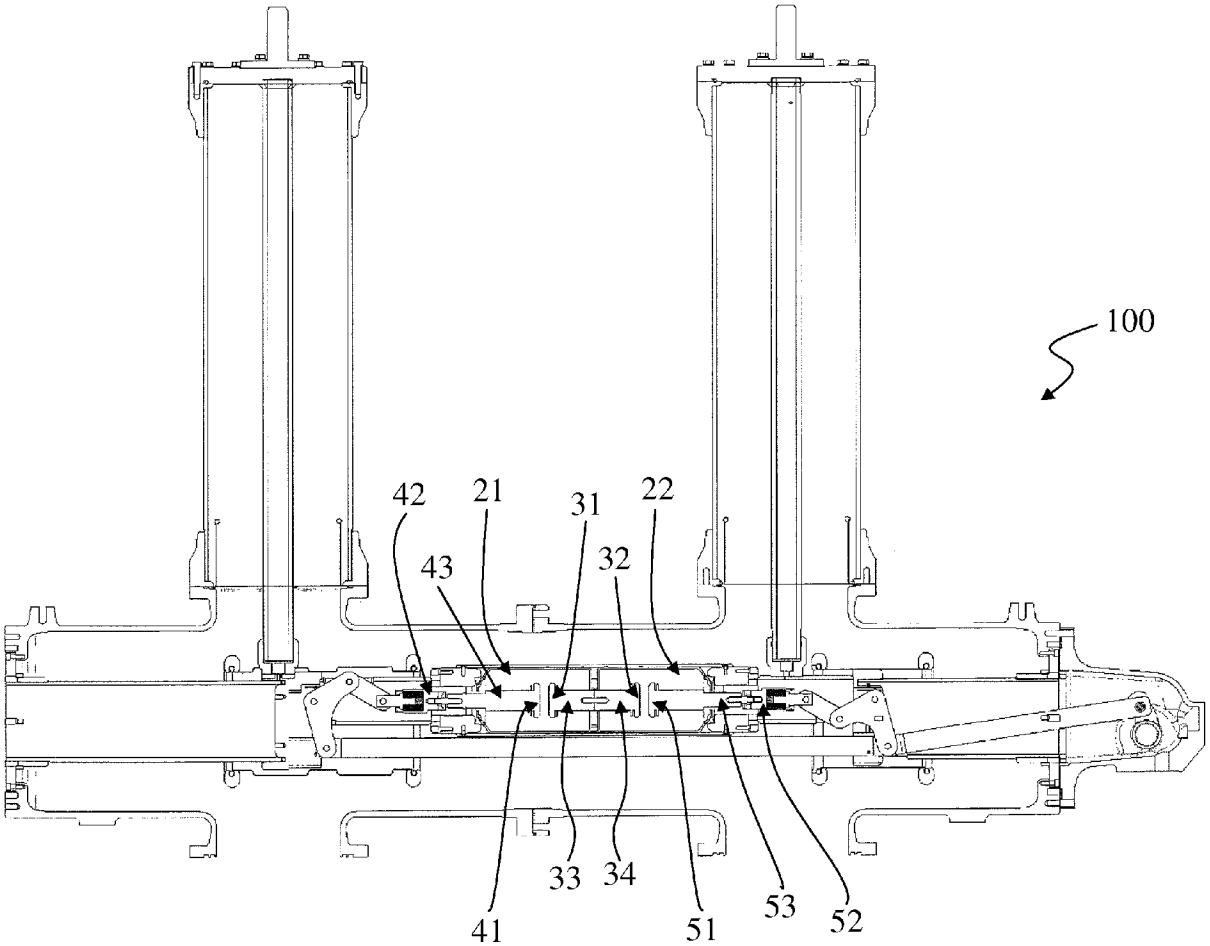
FIG. 2 is a side view showing the high-voltage switching device in a second open position in accordance with an exemplary embodiment of the present disclosure.

FIG. 1 is a side view showing the high-voltage switching device in a first closed position in accordance with an exemplary embodiment of the present disclosure. FIG. 2 is a side view showing the high-voltage switching device in a second open position in accordance with an exemplary embodiment of the present disclosure. With reference to the Figures, the high voltage switching device according to the present disclosure, indicated by the overall reference 100, comprises an outer casing 1, and a current interruption assembly indicated by the reference number 10.

In an exemplary embodiment, the casing 1 can be a metal-clad casing, e.g., it is electrically conducting and can be connected to ground potential, or alternatively it can be a live tank or casing.

Further in the exemplary embodiments illustrated in FIGS. 1-2 the casing 1 is connected for instance to two bushings 2 each housing a respective conductor, e.g. a bar or rod 3. The bars 3 are connected each to a corresponding terminal 4, with the terminals 4 connected operatively to the interruption assembly 10. In practice, the bars 3, terminals 4 and related connections between them and with the interruption assembly 10, allow to realize input/output electrical connections of the switching device 100 for example with an external power line, with the current flowing through the interruption assembly 10 according to solutions well known or readily available to those skilled in the art and therefore not described herein in details.

The interruption assembly 10 includes at least one vacuum chamber 20 which is positioned inside the outer casing 1, a fixed contact assembly 30 including a first fixed contact 31 and a second fixed contact 32 which are positioned inside the at least one vacuum chamber 20, and a first movable-contact assembly 40 and a second movable-contact assembly 50 which includes a first movable contact 41 and a second movable contact 51, respectively.

The switching device 100 includes also a single actuating mechanism, globally indicated by the reference number 60. The mechanism 60 is a unique mechanism adapted to actuate both the first movable-contact assembly 40 and the second movable-contact assembly 50 between: 1) a first position in which the first movable contact 41 and the second movable contact 51 are electrically coupled inside the at least one vacuum chamber 20 with the first fixed contact 31 and the second fixed contact 32, respectively (see FIG. 1; switching device 100 in closed position); and 2) a second position in which the first movable contact 41 and the second movable contact 51 are electrically separated inside the at least one vacuum chamber 20 from the first fixed contact 31 and the second fixed contact 32, respectively. Such separated position is shown in FIG. 2 wherein the switching device 100 is opened and the flow of current is interrupted.

In the switching device 100 according to exemplary embodiments of the present disclosure, the fixed contact assembly 30 is interposed between the first movable contact assembly 40 and the second movable contact assembly 50. Further, the first movable contact assembly 40, the second movable contact assembly 50, and the actuating mechanism 60 are arranged, namely configured and/or mutually operatively associated, so as the first movable contact 41 and the second movable contact 51 move, along a reference axis 101, one towards the other when switching from the second position illustrated in FIG. 2 to the first position of FIG. 1 and one away from the other when switching from the second position (starting position illustrated by FIG. 2) to the first position illustrated in FIG. 1.

According to an exemplary embodiment described herein, the first movable contact assembly 40, the second movable contact assembly 50, and the actuating mechanism 60 are arranged, namely configured and/or mutually operatively associated, so as the first movable contact 41 and the second movable contact 51 cover the same distance D1, D2, respectively, along the reference axis 101, when moving between the two positions.

As schematically illustrated in the Figures, the energy specified to actuate the movable-contact assembly 40 and 50 is supplied by a motor 5, e.g. an electrical rotating motor, or a spring-operated motor. The motor 5 can be positioned inside or outside the casing 1, or as shown in the exemplary embodiments of FIGS. 1-2 it can be positioned inside a housing 6 which is connected mechanically to the body of the casing 1, e.g. at an end thereof.

The motor 5 can be constituted by any suitable motor already available on the market; for example the motor 5 can be selected from the MotorDrive series models MD1.n, such as the model MD1.3, or the type BLK82, or the ESH9 commercialized by the ABB® Group.

As illustrated in FIGS. 1-2, the first movable contact assembly 40, the second movable contact assembly 50, and the fixed contact assembly 30 can be arranged substantially aligned along the first reference axis 101 so that they are electrically connected in series when the first movable contact 41 and the second movable contact 51 are electrically coupled in the first position with the first fixed contact 31 and the second fixed contact 32, respectively (see FIG. 1).

In exemplary embodiment of the present disclosure, the first movable contact assembly 40 includes, for example, two main parts, e.g. a support part 42 which protrudes outside the at least one vacuum chamber 20 and is suitable to be connected to the actuating mechanism 60, and a second part 43 which extends into the vacuum chamber 20 and includes, at its end free portion, the contact part 41 meant to mate with the first fixed contact 31;

Likewise, the second movable contact assembly 50 includes for example two main parts, e.g. a support part 52 which protrudes outside the at least one vacuum chamber 20 and is suitable to be connected to the actuating mechanism 60, and a second part 53 which extends into the vacuum chamber 20 and comprises, at its end free portion, the contact part 51 meant to mate with the second fixed contact 32.

The two main parts 42, 43 are mechanically connected to each other and also the two main parts 52-53 are mechanically connected to each other, e.g. screwed, according to solutions well known in the art or in any case readily available to those skilled in the art.

In turn, in the exemplary embodiment illustrated in FIGS. 1-2, the fixed contact assembly 30 includes at least a first piece 33 including the first fixed contact 31 and a second piece 34 including the second fixed contact 32. The first and second pieces 33, 34 are mechanically connected to each other, e.g. by screwing so as to form a single body.

In an exemplary embodiment of the present disclosure, the switching device 100 includes: a first vacuum chamber 21 having a first back surface 23, and a first main body 25 which extends from the first back surface 23. A second vacuum chamber 22 has a second back surface 24, and a second main body 26 which extends from the second back surface 24. The first and second vacuum chambers 21, 22 are positioned back-to-back with their respective back surfaces 23, 24 adjacent (or facing) to each other with the first main body 25 and the second main body 26 which extend from the respective first and second back surfaces 23, 24 in opposite directions from each other along the reference axis 101.

The fixed contact assembly 30 can be placed at the zone where the first and second back surfaces 23, 24 are placed adjacent to each other with the first fixed contact 31 extending into the first vacuum chamber 21 and the second fixed contact 32 extending into the second vacuum chamber 22. The first movable contact 41 couples to/separates from the first fixed contact 31 inside the space under vacuum surrounded by the first vacuum chamber 21. The second movable contact 51 couples to/separates from the second fixed contact 32 inside the space under vacuum surrounded by the second vacuum chamber 22.

According to another exemplary embodiment disclosed herein, it is possible to use only one vacuum chamber 20 defining a unique internal space under vacuum inside which the two couple of contacts 41-31 and 51-32 couple/separate. It could also be possible to use a separating wall positioned transversally with respect to the axis 101 and which divides the internal space under vacuum of the chamber 20 into two separated half spaces each devoted to coupling/separation of a respective couple of contacts 31-41, 32-51.

The actuating mechanism 60 can be adapted to actuate substantially synchronously the first and second movable contacts 41, 51 when causing them to move between the first position and the second position (both directions).

The actuating mechanism 60 can be arranged to self-lock the first movable contact 41 and the second movable contact 51 in the first position, e.g., when the switching device 100 is in the closed status.

With the above definition of self-lock, it is hereby meant that the mechanism 60, through its various components, as it will be described in the following, can assume an overall position suitable to keep the movable contacts in the first position without relying on a constraining force exerted by the motor 5.

In an exemplary embodiment of the present disclosure, the actuating mechanism 60 includes a first actuating sub-assembly 70 connected to the first movable contact assembly 40 and a second actuating sub-assembly 80 connected to the second movable contact assembly 50.

The actuating mechanism 60 further includes a first rod 61 and a second rod 64 which are made for example of electrically insulating material. The first rod 61 is positioned between the outer casing 1 and the at least one vacuum chamber 20 or the two chambers 21, 22 depicted in FIGS. 1 and 2, and mechanically connects the first actuating sub-assembly 70 with the second actuating sub-assembly 80. The second rod 64 connects operatively the first rod 61 with the motor 5, e.g. its shaft.

Figure 3:
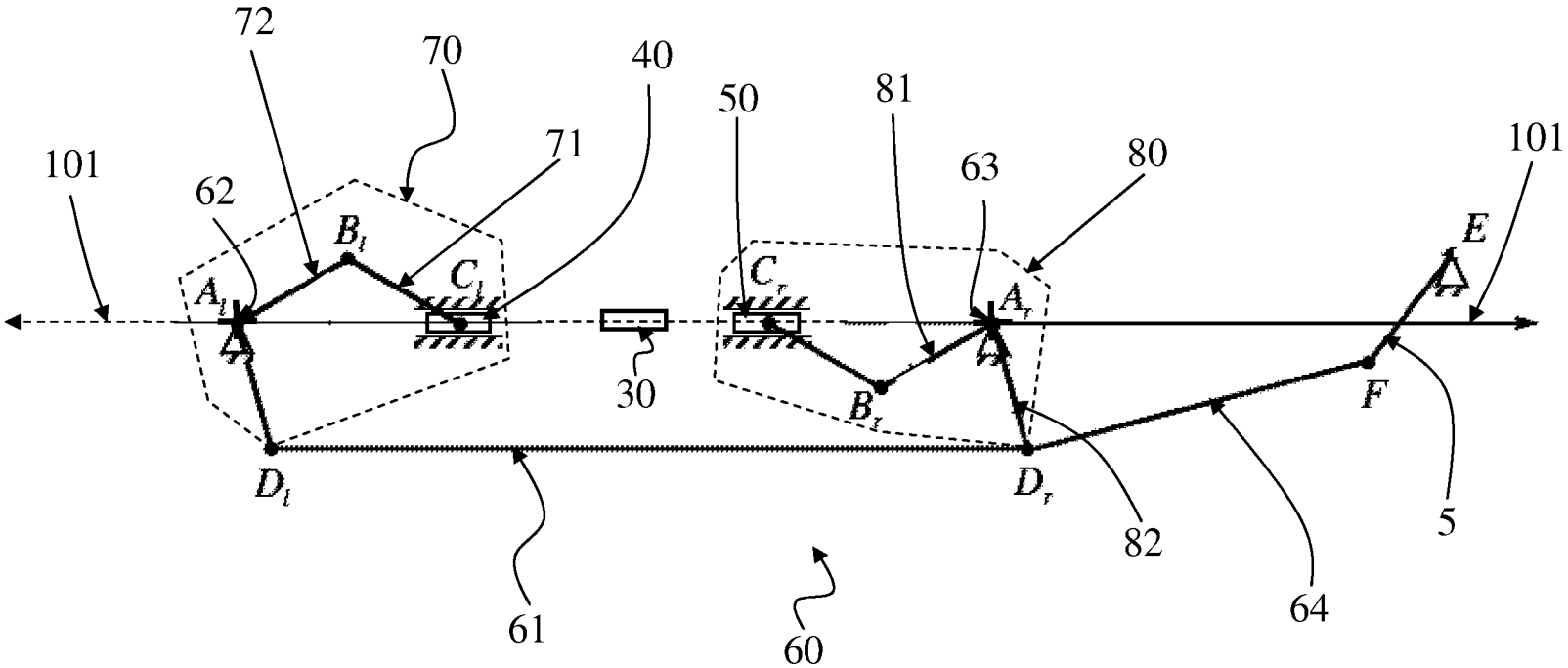
FIG. 3 is a schematic representation of the various elements of an actuating mechanism used in the switching device of FIGS. 1 and 2 in accordance with an exemplary embodiment of the present disclosure.

FIG. 3 is a schematic representation of the various elements of an actuating mechanism used in the switching device of FIGS. 1 and 2 in accordance with an exemplary embodiment of the present disclosure. The first actuating sub-assembly 70 includes: a substantially straight link 71, for example made of electrically insulating material, which is connected (point Cl of FIG. 3) to the first movable contact assembly 40. An L-shaped lever 72 which has a first end (Bl) connected to the straight link 71, and a second end (Dl) connected to a respective end of the first insulating rod 61. The L-shaped lever 72 is mounted at point (Al) of its elbow portion pivotally around an axis 62 transversal with respect to said reference axis 101. Such mounting can be realized for example directly on the internal surface of the casing 1 or on a piece which is connected to such internal surface. In turn, the second actuating sub-assembly 80 includes: a substantially straight link 81, for example made of electrically insulating material, which is connected to the movable contact assembly 50 (point Cr of FIG. 3). An L-shaped lever 82 which has a first end (Br) connected to the straight link 81, and a second end (Dr) connected to a respective end of the first insulating rod 61. The L-shaped lever 82 is also mounted at point (Ar) of its elbow portion pivotally around an axis 63 transversal with respect to said reference axis 101. Also this mounting can be realized for example directly on the internal surface of the casing 1 or on a piece which is connected to such internal surface.

When the switching device 100 has to open or close, the motor 5, e.g. in the form of an electric rotating motor, rotates clockwise or counterclockwise transmitting the movement thorough the second rod 64 to the other components of the mechanism 60 and thus to the movable contacts 41, 51. For example, starting from the open position of FIG. 2, the motor 5 rotates counterclockwise and pulls the second rod 64 which in turn pulls the rod 61. The rod 61 transmits the movement to the L-shaped levers 72, 82 which rotate around their respective axes 62, 63 and cause the corresponding links 71, 81, to push each the corresponding movable contact assembly 40 and 50. In this manner, the movable contacts 41, 51 slide along the reference axis 101 one towards the other until they arrive to touch each the respective fixed contact 31, 32 (position of FIG. 1). In this status, the mutual position of the various components of the actuating mechanism 60 is such that the contacts can be kept in the reached position without relying on a biasing force exerted by the motor 5. In this position the points (Al), (Bl) (Cl) and (Ar), (Br) (Cr) are substantially aligned along the reference axis 101 as illustrated in FIG. 1.

According to an exemplary embodiment disclosed herein, the switching device 100 offers some improvements over prior art solutions. For example, the switching device 100 as a whole is rather compact, structurally simplified and electrically improved due to a better and more balanced distribution of the voltage inside the casing 1 along the vacuum chamber (s).

Such results are achieved thanks to a solution which in principle makes the switching device 100 according to the present disclosure easy to be used in connection with different types of electric substations.

Hence, the present disclosure also encompasses an electric power distribution and/or transmission substation characterized in that it includes a high voltage switching device 100 of the type according to the above-described exemplary embodiment. Furthermore, in another exemplary embodiment, more than one switching device 100 can be used in a single substation.

The exemplary switching device 100 thus conceived is susceptible of modifications and variations, all of which are within the scope of the inventive concept as defined in the appended claims. Any possible combination of the previously disclosed embodiments/alternatives can be implemented and has to be considered within the inventive concept of the present disclosure. All the details may furthermore be replaced with technically equivalent elements. For example, any of the previously described components may be differently shaped, or used in a different number or parts or elements, or the components previously described can be differently connected with respect to each other. For instance, the movable contact assemblies 40, 50 or the fixed contact assembly 30 can be realized in a unique piece or in more than two pieces. The switching device 100 can be equipped with other components, e.g. sensors, earth switches or disconnectors positioned inside the casing 1 and independent or operatively connected to the interruption assembly 10.

Also the materials used, so long as they are compatible with the specific use and purpose, as well as the dimensions, may be any according to the desired specifications and the state of the art.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

What is claimed is:

1. A high-voltage switching device comprising:

an outer casing;

a current interruption assembly including at least one vacuum chamber which is positioned inside said outer casing;

a fixed contact assembly including a first fixed contact and a second fixed contact positioned inside said at least one vacuum chamber;

a first movable-contact assembly and a second movable-contact assembly including a first movable contact and a second movable contact, respectively;

a single mechanism for actuating both said first and second movable-contact assemblies between a first position in which said first movable contact and said second movable contact are electrically coupled inside said at least one vacuum chamber with said first fixed contact and said second fixed contact, respectively, and a second position in which said first movable contact and said second movable contact are electrically separated inside said at least one vacuum chamber from said first fixed contact and said second fixed contact, respectively, wherein said fixed contact assembly is interposed between said first and second movable contact assemblies, said first movable contact assembly, said second movable contact assembly, and said actuating mechanism is arranged so that said first movable contact and said second movable contact move, along a reference axis, one towards the other when switching from said second position to said first position and one away from the other when switching from said second position to said first position.

2. The high-voltage switching device according to claim 1, wherein said actuating mechanism is adapted to actuate synchronously said first and second movable contacts between said first and second positions.

3. The high-voltage switching device according to claim 1 wherein said actuating mechanism is arranged to self-lock said first and second movable contacts in said first position.

4. The high-voltage switching device according to claim 1, wherein said first movable contact assembly, said second movable contact assembly and said fixed contact assembly are substantially aligned along said first reference axis and electrically connected in series when the first and second movable contacts are electrically coupled in said first position with said first fixed contact and said second fixed contact, respectively.

5. The high-voltage switching device according to claim 1, wherein the first movable contact assembly, the second movable contact assembly, and the actuating mechanism are arranged, so that the first movable contact and the second movable contact cover along the reference axis a same distance, respectively, when moving between said first and second positions.

6. The high-voltage switching device according to claim 1, wherein said actuating mechanism comprises a first actuating sub-assembly connected to said first movable contact assembly, a second actuating sub-assembly connected to said second movable contact assembly, and a first rod which is positioned between said outer casing and said at least one vacuum chamber and mechanically connects said first and second actuating sub-assemblies.

7. The high-voltage switching device according to claim 6, wherein said first and second actuating sub-assemblies each comprises a straight link connected to the respective first and second movable contact assembly, and an L-shaped lever having a first end connected to the respective straight link and a second end connected to a respective end of said insulating rod, and wherein said L-shaped lever of each first and second actuating sub-assemblies is pivotally mounted around a corresponding axis transversal with respect to said reference axis.

8. The high-voltage switching device according to claim 7 wherein said actuating mechanism comprises a second rod which has one end operatively connected to said first rod and a second end operatively connected to a motor.

9. The high-voltage switching device according to claim 1 comprising:

a first vacuum chamber having a first back surface and a second vacuum chamber having a second back surface, said first and second vacuum chambers being positioned back-to-back with their respective back surfaces adjacent to each other and having each a first main body and a second main body which extend from the respective first and second back surfaces in opposite directions from each other along said reference axis.

10. The high-voltage switching device according to claim 9 wherein said fixed contact assembly is placed at the position where said first and second back surfaces are placed adjacent to each other with said first fixed contact extending into said first vacuum chamber and said second fixed contact extending into said second vacuum chamber.

11. The high-voltage switching device according to claim 1 wherein said fixed contact assembly comprises at least a first piece including said first fixed contact and a second piece including said second fixed contact, said first and second pieces being mechanically connected to each other so as to form a single body.

12. An electric power distribution and/or transmission substation comprising:

a high voltage switching device according to claim 1.

13. A high-voltage switching device comprising:

a current interruption assembly including at least one vacuum chamber;

a fixed contact assembly including a first fixed contact and a second fixed contact positioned inside said at least one vacuum chamber;

a first movable-contact assembly having a first movable contact;

a second movable-contact assembly having a second movable contact;

a single mechanism for actuating said and second movable-contact assemblies between a first position and a second position, wherein in said first position said first movable contact is electrically coupled to said first fixed contact and said second movable contact is electrically coupled to said second fixed contact, wherein in said second position said first movable contact is electrically separated from said first fixed contact and said second movable contact is electrically separated from said second fixed contact, and wherein said fixed contact assembly is interposed between said first and second movable contact assemblies, and wherein said first movable contact and said second movable contact move towards and away from one another along a reference axis based on a respective starting position and actuation by the actuating mechanism.

14. The high-voltage switching device of claim 13, wherein the first movable contact moves toward the second movable contact when switching from said second position to said first position.

15. The high voltage switching device of claim 13, wherein the first movable contact moves away from the second movable contact when switching from said first position to said second position.

16. The high voltage switching device of claim 13, wherein the second movable contact moves toward the first movable contact when switching from said second position to said first position.

17. The high voltage switching device of claim 13, wherein the first movable contact moves away from the second movable contact when switching from said first position to said second position.

18. The high voltage switching device of claim 13, wherein electrical coupling of the first movable contact with the first fixed contact and the second movable contact with the second fixed contact occurs inside at least one vacuum chamber.

19. The high voltage switching device of claim 13, wherein the respective starting position is the first or second position.

* * * * *